United States Patent [19]

Powers et al.

[11] Patent Number: 4,846,736

[45] Date of Patent: Jul. 11, 1989

[54] IGNITION WIRE TERMINAL

[75] Inventors: Charles W. Powers, St. Clair; E. J. Plouffe, Port Huron, both of Mich.

[73] Assignee: Prestolite Wire Corporation, Farmington Hills, Mich.

[21] Appl. No.: 175,679

[22] Filed: Mar. 23, 1988

Related U.S. Application Data

[63] Continuation of Ser. No. 590,552, Mar. 19, 1984, which is a continuation of Ser. No. 373,376, Apr. 30, 1982, abandoned.

[51] Int. Cl.[4] ..... H01R 11/00

[52] U.S. Cl. ..... 439/738

[58] Field of Search ..... 339/223 S, 253, 258 R, 339/258 RR

[56] References Cited

U.S. PATENT DOCUMENTS

| | | | |
|---|---|---|---|
| 1,331,928 | 2/1920 | Katzung | 339/258 R |
| 3,597,723 | 8/1971 | Schmidt et al. | 339/223 S |
| 4,209,221 | 6/1980 | Chupak et al. | 339/223 S |

FOREIGN PATENT DOCUMENTS

| | | | |
|---|---|---|---|
| 2143424 | 3/1973 | Fed. Rep. of Germany | 339/253 R |
| 136439 | 12/1919 | United Kingdom | 339/258 RR |
| 327553 | 4/1930 | United Kingdom | 339/258 RR |

*Primary Examiner*—Joseph H. McGlynn
*Attorney, Agent, or Firm*—Remy J. VanOphem

[57] ABSTRACT

A one piece ignition wire terminal which does not require a separate spring to provide dependable retaining force to a terminal, and which may be used either as a straight ignition wire terminal or a bent ignition wire terminal, is crimped to an ignition cable over only a portion of its crimping area, to increase the retention of the terminal to the cable. The terminal includes a barrel portion with an integral spring formed by cutting a generally U-shaped slot in the material of the terminal, forming a spring tongue portion, which is provided with a radial projection. The radial projection may be directed inwardly, for use with a conventional spark plug-type terminal, or outwardly, for use with a conventional distributor socket. The ignition terminal is made usable either as a straight terminal or a bent terminal by providing it with three deformed sections in an intermediate channel section, including inward facing deformations at the edges of the channel, and a third inward deformation at the bottom of the channel. The resulting intermediate section is not significantly weakened, and may be made into a bent section by bending in the direction that places the third deformation at the apex of an obtuse angle. The crimpable area of the terminal may be crimped to an ignition cable over only approximately one-half of its length, the uncrimped length forming a diverging funnel portion adjacent the end of the ignition cable.

12 Claims, 6 Drawing Sheets

IGNITION WIRE TERMINAL

This is a continuation, division, of application Ser. No. 590,552 filed Mar. 19, 1984 which is a continuation of application Ser. No. 373,376 filed Apr. 30, 1982, now abandoned.

This invention relates to a terminal for an ignition cable such as used with automotive internal combustion engines and pulse combustion furnaces. In particular, this application relates to an ignition wire terminal which is usable to connect an ignition cable to a spark plug terminal, or to a distributor cap socket.

BACKGROUND OF THE INVENTION

Various types of terminals have been provided for ignition wire, to allow it to be connected to a spark plug or other device having a like shape, and to removably connect it to an automotive distributor. Such devices are typically in the form of an expandable split tubular portion adapted to be placed over a male connector, such as that of a spark plug, or to be compressed and forced into a conventional cup-shaped tubular socket of an automotive distributor, with a crimpable portion to be crimped around an end of a conventional resistive-core ignition cable, a section of exposed central core being folded back over the jacket to form a conventional "strip and fold back" connection, and with an intermediate web portion interconnecting the tubular portion and the crimpable portion.

The split tubular portions have been provided with various spring means for retaining them to a spark plug terminal or the like, such as a C-shaped spring steel member slipped over the tubular portion and have projections which extend inwardly through openings in the tubular portion to bear against a spark plug terminal or the like, or with inwardly-displaced wall sections. The intermediate portions have been provided with cutouts, to allow for applications where bent terminals are desired, together with reinforcing means which extend into the crimped area, or which interlock, to aid in maintaining the desired bend. The crimpable sections have been made with various arrangements of ridges, protruding tangs, and other similar features, to enhance the retention of the outer jacket of the ignition cable, to reduce the possibility that the cable will be pulled from its termination in an attempt to disconnect the ignition terminal by pulling on the ignition cable. One reason for these types of damage is the unpredictable and uncontrollable retaining forces provided by an expandable split tubular section. Also, ignition wire terminals have been made in two pieces, the crimpable portion and the connecting portion being separate pieces of different material, so that the expandable tubular connection portion may be made of a stronger, stiffer material than the crimpable portion, in an attempt to repeatably control the retaining force provided by the expandable tubular portion.

The instant invention overcomes these and other deficiencies of the prior art.

SUMMARY OF THE INVENTION

The instant invention provides a unitary ignition wire terminal, having a connecting tubular barrel portion which contains an integral spring means providing an easily controllable and maintainable retaining force, without necessitating expansion of the entire tubular connection barrel, a crimpable portion which is crimped to provide a significantly higher retaining force between an ignition cable and the connector, and an integral intermediate connecting portion connecting the tubular barrel connector with the crimpable portion, which is provided with deformed portions which do not detrimentally affect the stiffness of a straight ignition terminal, yet allow it to be bent into a strong and stable bent connection terminal. Generally, the tubular barrel connection portion includes one or more tongue portions formed by cutting a generally U-shaped slot into the side of the cylindrical barrel portion, and providing a tip formed by the bight of the U-shape with a formed projection. This tongue portion acts as an integral spring, and lies generally in the plane of the cylindrical barrel portion, the projection engaging a spark plug terminal, if it is an inward projection, or engaging a distributor socket, if it is an outward projection. Such slots and projections are easy and efficient to form during the conventional stamping of blanks from flat metal which are subsequently bent into connection, crimpable and intermediate sections.

The intermediate section includes three adjacent inwardly-deformed portions which do not seriously degrade the stiffness of the intermediate portion of a straight ignition wire terminal, and, when bent in the reverse direction, provide a strong and stable bent intermediate section of a bent ignition wire terminal.

The crimpable portion is crimped over only a portion of its length, the crimped portion being a generally cylindrical portion compressing the ignition cable, the uncrimped portion forming a diverging funnel portion, so that, in order for ignition cable to be pulled away from the terminal, an uncompressed portion of the ignition cable must first be compressed in the diverging funnel portion before it can be pulled through the tightly crimped section. This has been found to provide a higher retaining force between the ignition cable and the ignition wire terminal. This is believed to result from the higher energy which must be imparted to the ignition cable to allow it to be compressed and pull away from the ignition wire terminal, and also because the cable is forced to remain together, rather than the bond between the jacket and insulator of the cable being broken, allowing the insulation and conductive core portions to be pulled away from the ignition wire terminal, allowing the jacket portion to collapse and also pull away.

The electrical connection between the ignition cable and the ignition wire terminal may be further improved in the manner shown in U.S. Pat. No. 4,284,322, dated Aug. 18, 1981, and entitled, "Ignition Cable Terminal Construction," herein incorporated by reference, by placing a sheet of conductive material between the outer jacket portion and the folded-back central core portion.

Thus, an ignition wire terminal according to the invention has a unitary body with novel features in each of its three sections, which may obviously be used independently, and is usable to make connection with either male or female ignition wire connection terminals.

Thus, it is a primary object of the invention to provide an ignition wire terminal having a linearly extending cylindrical barrel portion, a linearly extending hemicylindrical or half-tubular intermediate channel portion integral with the cylindrical barrel portion, and a linearly extending crimpable portion integral with the intermediate portion, the cylindrical barrel portion defining an integral spring means for retaining the ignition wire terminal to an ignition wire connection terminal, the integral spring means being a tongue portion formed in the cylindrical barrel portion by a generally U-shaped slot and disposed substantially in the plane of the cylindrical barrel portion, and including a tip portion defining a radial projection adapted to cooperate with an ignition wire connection terminal. It is an advantage of the invention that the force provided by such an integral spring is easily controlled and maintained, since it is not necessary to attempt to control or maintain the force provided by an entire expandable barrel portion.

It is a further objective of the invention to provide such an ignition wire terminal with an intermediate portion including first, second and third deformed portions, two of the deformed portions being formed in facing edges of the intermediate portion, the third deformed portion being between the two first deformed portions in the body of the intermediate portion. It is an advantage of this feature that the deformed portions do not significantly degrade the stiffness of the intermediate portion, but, when bent in a direction where the third deformed portion is the apex of an obtuse angle, and the first and second deformed portions are straightened into smoothly curved portions laying at the apex of an obtuse angle, the resulting bent ignition wire terminal is strong and stable in its bent condition.

It is a further advantage of the invention that the absence of projections and obstacles around the barrel portion of an ignition terminal according to the invention, since the integral spring means lies substantially in the plane of the barrel portion, greatly facilitates the installation of conventional terminal insulating boots, which are applied to the cable assembly following the attachment of an ignition terminal to the ignition cable.

BRIEF DESCRIPTION OF THE DRAWINGS

Other objectives, features and advantages of the invention will become apparent from the drawings and descriptions that follow.

DETAILED DESCRIPTION OF THE INVENTION

Figure 1:
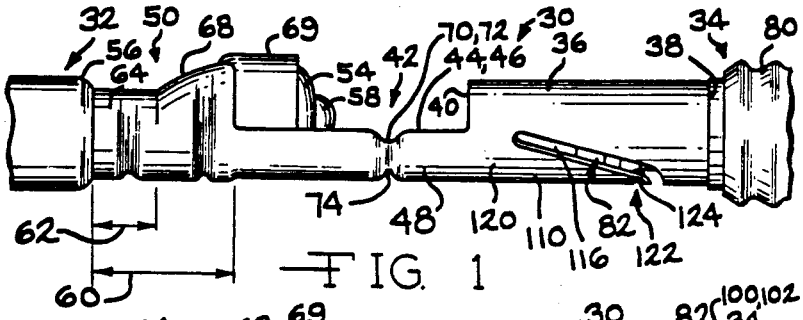
FIG. 1 is a side elevational view of an ignition cable terminated with an ignition wire terminal according to a first preferred embodiment of the invention connected to a spark plug terminal.

Referring to FIGS. 1–4, there is shown an ignition wire terminal 30 according to the first preferred embodiment of the invention, electrically and mechanically joined to an ignition cable 32 and connected to a male connection terminal shown as spark plug 34. Ignition wire terminal 30 includes a first linearly extending cylindrical or tubular barrel portion 36 having an open end surface 38 and an end portion 40 which is connected to and integral with a linearly extending hemicylindrical intermediate channel portion 42 having first and second edge portions 44 and 46 and a hemicylindrical body portion 48, which is also integral with a third linearly extending crimpable portion 50.

As shown in FIGS. 1–4, ignition cable 32 has a conductive central core portion 52, a concentric insulating layer 54 surrounding the central core portion, and a jacket portion 56 surrounding insulating layer 54. As conventional for a "strip and fold-back" termination, insulating layer 54 and jacket portion 56 are stripped or removed from an end portion of core portion 52, leaving an exposed portion 58 which is folded back and placed in contact with jacket layer 56, being disposed between jacket layer 56 and ignition fire terminal 30.

The third crimpable portion, shown in greater detail in FIGS. 5–12 and 13–15, before crimping, is a U-shaped portion having a base portion integral with the hemicylindrical channel portion 42 and first and second crimpable side portions. In this regard, it should be noted that channel portion 42 is described as hemicylindrical, and preferably is in the form of a lengthwise half of a cylindrical tube, but may be any desired portion of a cylindrical tube, or any other suitable conventional shape, particularly if a bent ignition wire terminal is not desired.

As shown in FIGS. 1–4, crimpable portion 50 has been crimped in a novel manner. As best shown in FIG. 1, crimpable portion 50 has a total length 60 but, as will be apparent, is crimped only over a length 62 which is approximately one-half of the total length 60. This produces a tubular crimped portion 64, and a corresponding section of compressed ignition cable 66, and an uncrimped portion forming a diverging funnel shaped portion 68, from which an end 69 of ignition cable 32 protrudes. As stated above, this novel crimping procedure produces a mechanical connection which has been found to be superior to that of a conventional crimp, in which the crimpable portion is tightly crimped throughout its entire length. It is believed that this crimping procedure increases pull-out strength by forcing the layers of cable 32 to remain concentrically joined together, and be compressed through funnel section 68 before ignition cable 32 can be pulled out of ignition wire terminal 30. It is believed that in a conventional crimp, the bond between the layers of cable 32 fails when severe tension is applied, allowing the core 52 and insulation 54 to withdraw from the crimped area, leaving the jacket portion unsupported.

As illustrated in FIGS. 1–4, an ignition terminal according to the preferred embodiment of the invention is provided with deformed portions, so that it can be made into a bent ignition terminal, if desired. Obviously, these deformed portions could be omitted if only a straight ignition terminal is desired. As shown, first and second deformed portions 70 and 72 are formed in edge portions 44 and 46, adjacent each other, and mutually in the direction of the other. A third deformed portion 74 is intermediate the first and second deformed portions 70, 72 in body portion 48, and in the direction of edges 44, 46.

These deformed portions were formed in a prototype dimensional sample, made of brass, of an embodiment of the invention, with the intent of providing a terminal bent so that deformed portion 70 and 72 would continue to be deformed further in the same direction upon bending the ignition wire terminal, and third deformed portion 74 would stretch to become a smoothly rounded portion at the apex of an obtuse angle defined by the ignition wire terminal. This result was successfully attained on the brass sample.

However, an attempt to bend an embodiment of the invention made of the preferred material, stainless steel, in the planned direction resulted in a seriously distorted, unstable and undesirable bend. By chance, it was found that bending it in the opposite, unanticipated direction produced a smooth, stable and rigid bent ignition wire connector, with deformed portion 74 remaining substantially unchanged at an apex of an acute angle formed by the bent connector, and deformed portions 70 and 72 being straightened to define smoothly curved portions of edge portions 44, 46 at the apex of an obtuse angle formed by the bent connector.

Figure 2:
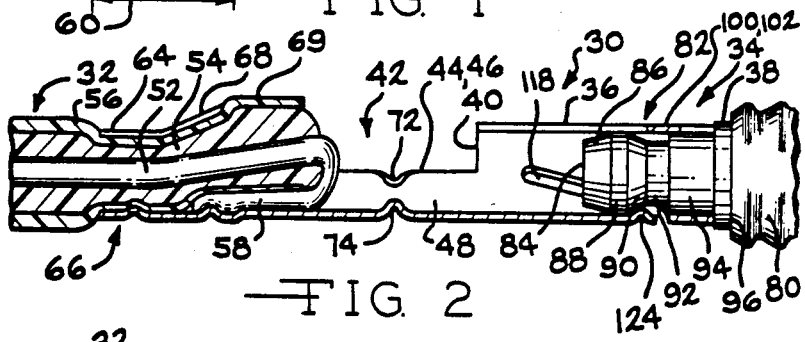
FIG. 2 is a sectional view of the embodiment of FIG. 1.
Figure 3:
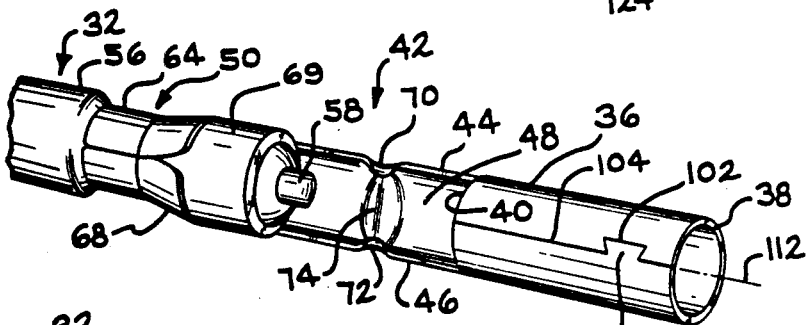
FIG. 3 is a top perspective view of the embodiment of FIG. 1.

Ignition wire terminal 30, in FIGS. 1 and 2, is shown connected to a spark plug, including an insulating portion 80 and a terminal portion 82. It should be noted that terminal portion 82 is of an industry-standard shape, which is used both for male spark plug terminals for automotive and furnace use, and also for male distributor terminals on internal combustion engines provided with distributors having such caps. As shown, terminal portion 82 has an end surface 84, a connected diverging frustoconical portion 86, a cylindrical portion 88, a converging frustoconical portion 90 and a neck portion 92. Variations are allowed in a base portion 94, but the overall height from surface 84 to a shoulder 96 is carefully controlled. When any embodiment of the invention is used in conjunction with a spark plug-type terminal, open end surface 38 of ignition wire terminal 30 tightly abuts shoulder 96.

FIGS. 1–4 show that, in all illustrated embodiments of the invention, barrel portion 36 is a locked or solid barrel, although, as will be apparent, barrel portion 36 could also be formed in the shape of a conventional expandable barrel portion, except that the expansion of such a barrel need not be controlled, due to the integral spring means according to the invention. As shown, barrel portion 36 is made a locked barrel portion by a dovetail projection 100 and a dovetail slot 102 formed in or on first and second edges forming seam 104. If desired, the locking action of dovetail slot and projection 102, 100 may be increased by staking, to expand the dimensions of dovetail projection 100 and shrink the opening of dovetail slot 102, in conventional manner.

Figure 4:
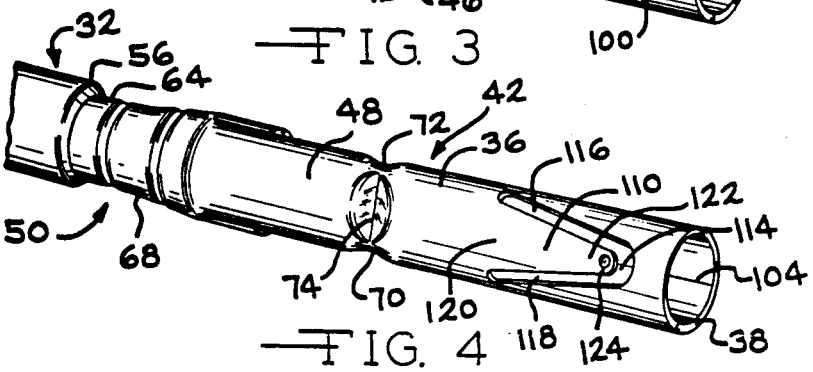
FIG. 4 is a bottom perspective view of the embodiment of FIG. 1.

As best seen in FIG. 4, integral spring means according to the preferred embodiment of the invention is an axial tongue portion 110 lying parallel to a lengthwise axis 112 of barrel portion 36, defined by a generally U-shaped slot having a bight 114 and outwardly diverging leg or side portions 116, 118, so that tongue portion 110 has a substantially wider base portion 120 than tip portion 122. Tip portion 122 is provided with a projection 124, here shown as an inward radial circular projection, projection 124 cooperating with converging frustoconical section 90 of terminal portion 82 to establish electrical contact with terminal portion 82 and hold terminal 82 firmly against shoulder 96. As will become apparent, projection 124 need not be a circular projection to hold ignition wire terminal 30 firmly against shoulder 96 of spark plug terminal portion 82, that projection 124 need not be an inwardly directed projection to form a functional ignition wire terminal according to the invention, and that a tongue portion according to the invention need not be axial. The embodiment illustrated in FIGS. 1–4, and also in FIGS. 9, 10, 15 and 16, provides the highest and most controllable pulloff force of all illustrated embodiments, since tongue portion 110, although lying substantially in the plane of barrel portion 36, is stiffened by lateral circular curvature, and the width of base portion 120 provides a stiff resilient hinge area for tongue portion 110.

Figure 5:
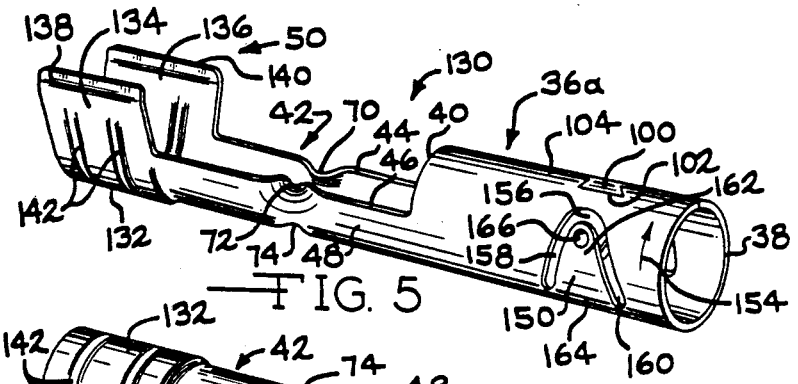
FIG. 5 is a first perspective view of a second preferred embodiment of an ignition terminal according to the invention.
Figure 6:
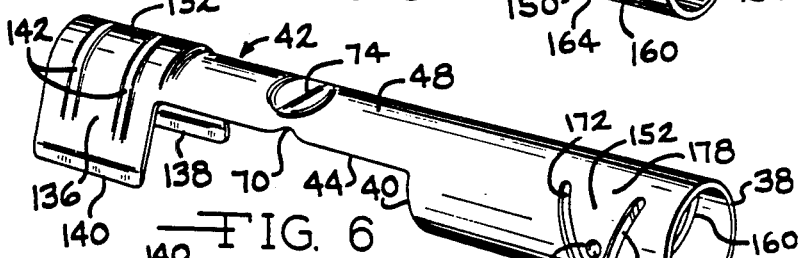
FIG. 6 is a second perspective view of the embodiment shown in FIG. 5 in a position inverted from the embodiment of FIG. 5.

Turning now to FIGS. 5 and 6, there is shown a second preferred embodiment 130, which is similar in many respects to the most preferred embodiment of the invention. In these figures, crimpable portion 50 is shown in uncrimped form, as a generally U-shaped portion having a base portion 132 integral with intermediate channel portion 42 and first and second side portions 134, 136 having edges 138, 140. Base portion 132 and side portions 134, 136 may be formed with ridges 142 or the like, for more securely holding an ignition cable 32, and could also be provided with a plurality of inwardly-extending pointed tangs to penetrate the jacket portion of an ignition cable 32. However, the retention provided with a crimping procedure according to the invention is believed to be more than adequate for any practical applications of an ignition wire terminal according to the invention.

In FIGS. 5 and 6, integral spring means according to the invention constitute first and second tongue portions 150 and 152, tongues 150 and 152 being oriented in a circumferential direction shown by arrow 154. Tongue portion 150 lies substantially in the plane of barrel portion 36*a*, and is defined by a generally U-shaped slot having a bight portion 156 and diverging leg or side portions 158, 160, defining tongue portion 150 with a base portion 164 significantly wider than tip portion 162. Tip portion 162 is provided with a radial projection 166. Second tongue portion 152 is defined by a generally U-shaped slot having a bight portion 170 and two diverging side or leg portions 172, 174, defining tongue portion 152 with a tip portion 176 and a base portion 178 significantly wider than the width of tip portion 176, and provided with a radial projection 180. As should be apparent, radial projections 166 and 180 are directed inwardly, towards each other, for use on a male terminal, and directed outwardly, away from each other, for use with a conventional female terminal. As in the case of the most preferred embodiment shown in FIG. 1, for use with a spark plug terminal, projections 166, 180 would cooperate with frustoconical portion 90 to hold end surface 38 against shoulder 96.

Figure 7:
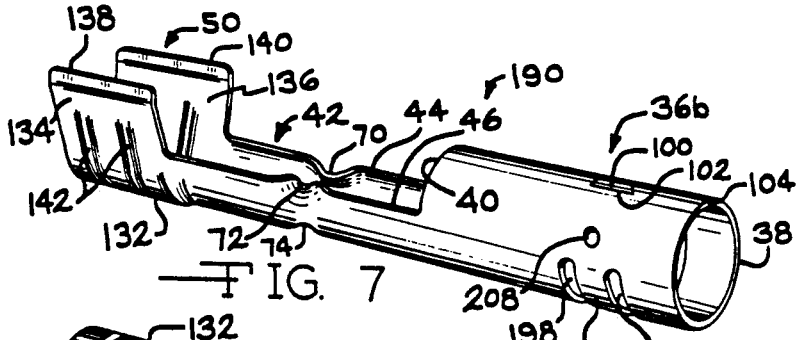
FIG. 7 is a first perspective view of an ignition wire terminal according to a third preferred embodiment of the invention.
Figure 8:
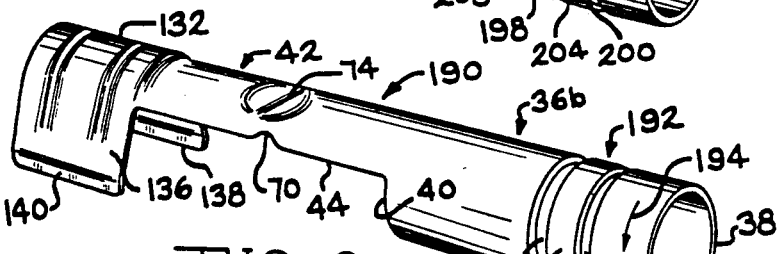
FIG. 8 is a second perspective view of the embodiment shown in FIG. 7, the ignition wire terminal being inverted from the position shown in FIG. 7.

Turning now to FIGS. 7 and 8, there are shown perspective views of a third preferred embodiment of the invention 190, which is also similar in several ways to the first preferred embodiment of the invention, but differs in the structure of the integral spring means.

As shown in FIG. 8, the integral spring means of the third preferred embodiment of the invention is circumferential tongue portion 192, extending around barrel portion **36*b* in a circumferential direction as shown by arrow 194 for slightly less than one-half of the total circumference of barrel portion 36*b*. Tongue portion 192 is defined by a generally U-shaped slot in barrel portion 36*b* having a bight portion 196 and leg or side portions 198 and 200, defining tongue portion 192 as having a tip portion 202 and a base portion 204 of substantially the same width as tip portion 202. Tip portion 202 is provided with a radial projection 206, and, diametrically opposite projection 206, barrel portion 36*b* is provided with a radial projection 208. As in all other embodiments of the invention, radial projections 206 and 208 are integrally formed by distorting the material of a spark plug terminal, forming a depression on one surface, causing a projection on the opposite surface of the material. Also, as with other embodiments of the invention, projections 206 and 208 would be directed inwardly, towards each other, to use third preferred embodiment 190 with a male terminal such as a spark plug terminal, and would be directed outwardly, away from each other, to use terminal 190** together with a conventional female distributor cap socket.

Figure 9:
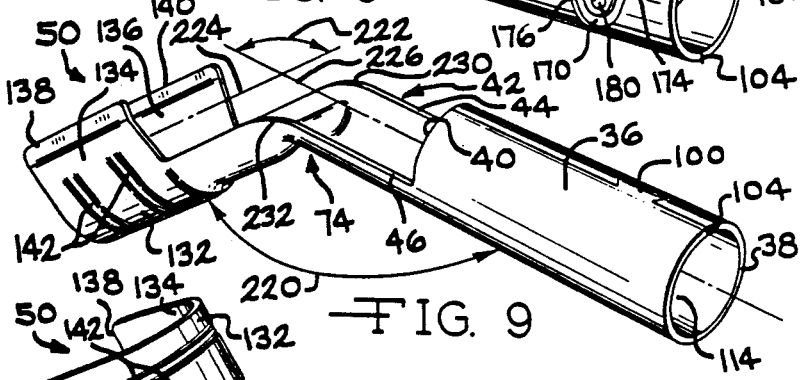
FIGS. 9 and 10 are perspective views of the embodiment shown in FIG. 1 bent to form a bent ignition wire terminal.
Figure 10:
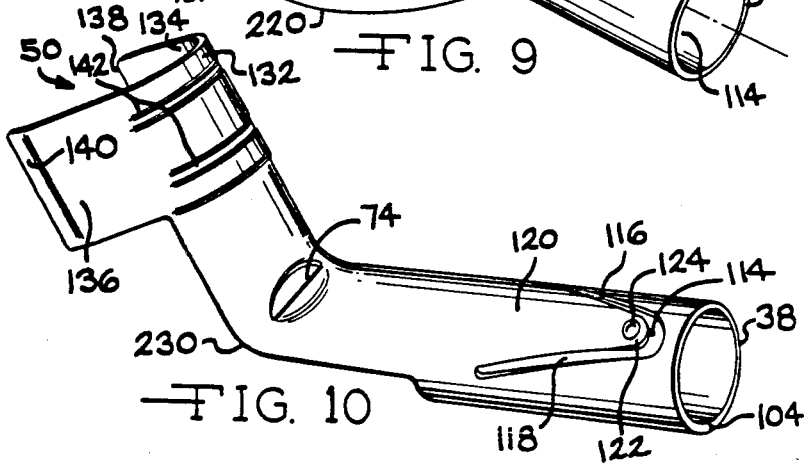

Turning for a moment to FIGS. 9 and 10, an ignition wire terminal 30 in accordance with the first preferred embodiment of the invention is shown as formed into a bent ignition terminal. For clarity, crimpable portion 50 is shown in its uncrimped state, not connected to an ignition cable, such as cable 32. As can be seen in FIG. 9, terminal 30 is bent in a first direction, so that base 132 of crimpable portion 50 forms an obtuse angle 220 with barrel portion 36, and barrel portion 36 forms an obtuse angle 222 with crimpable portion 50, indicated for clarity as an angle between a line 224 which is parallel to edges 138 and 140, and also parallel to the axis of base portion 132, and a line 226 which is parallel to the longitudinal axis of barrel portion 36.

Comparing FIGS. 1–4 and FIGS. 9 and 10, it can be seen that, in bent position, third deformed portion 74 is relatively unchanged, although it may enlarge somewhat during bending, at the apex of obtuse angle 220, and first and second deformed portions 70 and 72 have been straightened to form smooth undistorted bend areas 230 and 232, respectively, at the apex of an obtuse angle such as angle 222 formed by the bent ignition wire terminal.

As will be apparent, line 224, and angle 222 are unchanged when side portions 134 and 136 are crimped around an ignition cable, such as cable 32.

Figure 11:
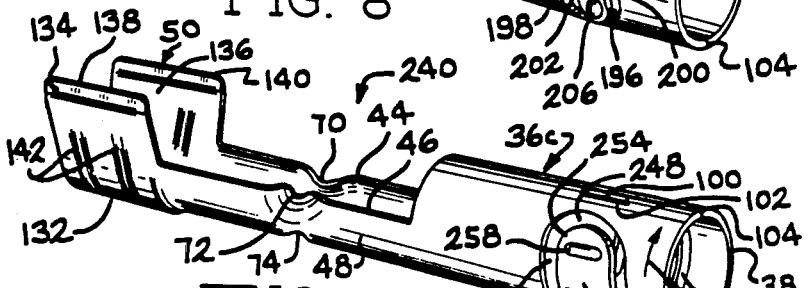
FIGS. 11 and 12 are perspective views of an ignition wire terminal according to a fourth preferred embodiment of the invention.
Figure 12:
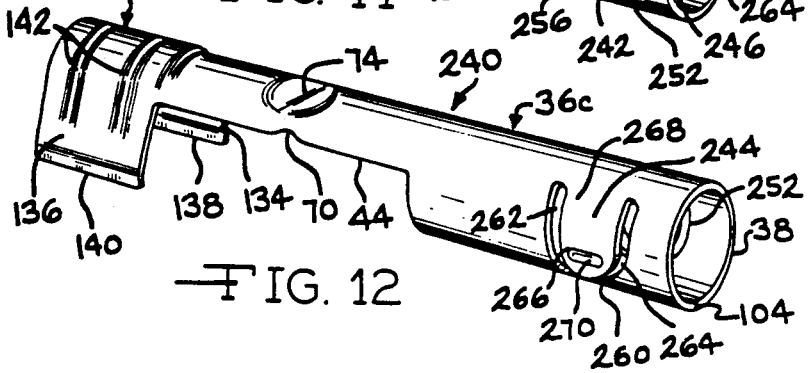

Proceeding now to FIGS. 11 and 12, there is shown a fourth preferred embodiment of the invention, which is similar in some respects to the second preferred embodiment of the invention shown in FIGS. 5 and 6, differing in the configuration of the integral spring means according to the invention.

As can be seen, barrel portion **36*c* of fourth preferred embodiment 240 of an ignition wire terminal according to the invention includes a first tongue portion 242 and a second tongue portion 244, tongue portions 242 and 244 lying substantially in the plane of barrel portion 36*c*, tongue portions 242 and 244 being circumferential tongue portions formed in a circumferential direction as indicated by arrow 246. First tongue portion 242 is defined by a generally U-shaped slot in barrel portion 36*c* having a bight portion 248 and leg or side portions 250 and 252. As illustrated, leg or side portions 250 and 252 are substantially parallel, and define a tongue portion 242 having a tip portion 254 and a base portion 256 which is approximately the same width as tip portion 254. Tip portion 254 is provided with a radial projection 258, projection 258 being a lengthwise radial projection extended in the direction of the axis of barrel portion 36*c*, identical to axis 112 shown in FIG. 3. As best shown in FIG. 12, second tongue portion 244 is defined by a generally U-shaped slot in barrel portion 36*c*, having a bight portion 260 and side or leg portions 262 and 264, defining a tongue portion 244 having a tip portion 266 and a base portion 268 which is approximately the same width as that of tip portion 266. Tip portion 266 is also provided with a linearly-extending radial projection 270, which is extended in the direction of the axis of the barrel member of an ignition terminal according to the invention, such as axis 112 shown in FIG. 3. As with all other embodiments of the invention, radial projections 258 and 270 are inward radial projections if the subject ignition wire terminal is to be used to cooperate with and make connection to a spark plug-type terminal such as terminal portion 82, shown in FIG. 1**, and are directed outwardly, away from each other, if the ignition wire terminal is to be used to cooperate with a conventional cup-shaped female distributor terminal, not shown.

Figure 13:
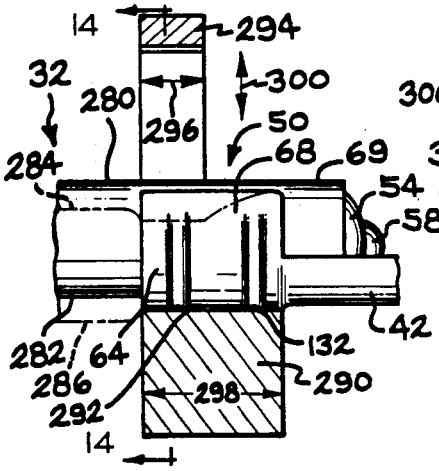
FIG. 13 is a side symbolic view of a novel method of crimping an ignition wire terminal to an ignition cable.
Figure 14:
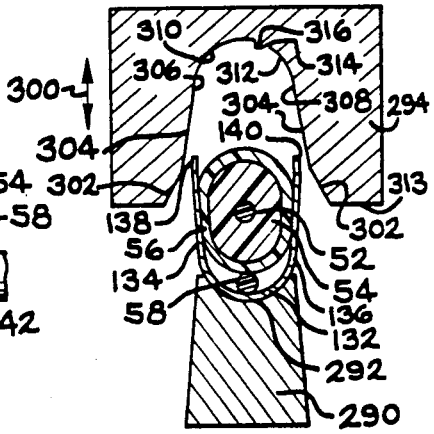
FIG. 14 is a sectional view taken along direction 14—14 in FIG. 13.

Turning now to FIGS. 13 and 14, a symbolic drawing of the procedure used to form a crimped portion with improved cable-retaining characteristics is illustrated. Cable 32 itself has a profile and positioning designated by solid lines 280 and 282, before the crimping operation, and a position and profile designated by phantom lines 284 and 286 following the crimping operation. As can be seen, a stripped exposed end 58 of core portion 52 is folded back in contact with jacket portion 56, and this end of cable 32 is placed in crimpable portion 50 of an ignition wire terminal according to the invention, so that it protrudes slightly beyond side portions 134, 136, into channel portion 42, although this protrusion is not necessary to practice the invention or to provide the benefits of the invention. The folded back end 58 is placed in contact with base portion 132 of crimpable portion 50, so that it will not be damaged when side portions 134, 136 are crimped around cable 32. Base portion 132 is placed upon a supporting die 290 which has a surface 292 which is adapted to generally conform to the outer surface of base portion 132. A crimping die 294 is provided, preferably having a length 296 approximately identical to the length of tubular crimped portion 64, shown as length 62 in FIG. 1, approximately one-half the length 298 of die 290, which is approximately identical to the total length 60 of crimpable portion 50, as best shown in FIG. 1. Alternatively, die 294 may be suitably configured and offset from die 290 to produce the equivalent results. Die 294 is mounted to be reciprocated in a direction shown with arrow 300. Die 294 is a conventional overlap crimping die, having converging entry surfaces 302 and 304. As will be apparent, when die 294 is moved towards die 290, converging surfaces 302 and 304 will begin to bend portions 134 and 136 towards each other. However, when portions 134 and 136 reach points 306 and 308, respectively, they will begin to be bent inwardly with different radii. Arcuate surface 310 preferably has the same radius of curvature as arcuate, surface 312, with the locating point of arcuate surface 310 higher than arcuate surface 312 with respect to surface 313. Arcuate surface 312 is provided with a groove 314 and a projection 316, in conventional manner. As die 294 is moved towards die 290, edge 138 will follow surface 310, and edge 140 will follow surface 312, pass over groove 314, and be deflected towards cable 32 by projection 316, thus folding edge 140 under edge 138, so that portion 134 overlaps portion 136.

This forms a retaining portion having a generally tubular crimped portion crimped around and compressing cable 32, and an uncrimped portion forming a diverging funnel shaped portion, and leaving an uncompressed end portion 69 extending beyond the funnel shaped portion onto channel portion 42. As stated before, this construction provides a significant improvement in the level of force required to pull cable 32 out of crimpable portion 50 of an ignition wire terminal according to the invention.

Figure 15:
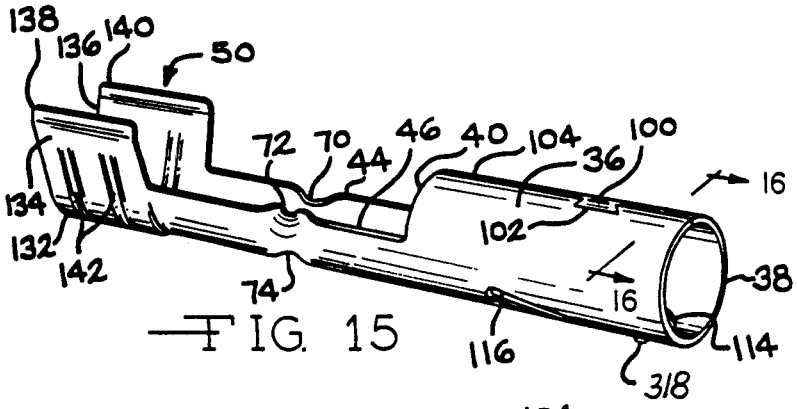
FIG. 15 is a perspective view of an ignition wire terminal according to the first preferred embodiment of the invention with an outwardlyfacing projection and adapted to be connected to a female socket.
Figure 16:
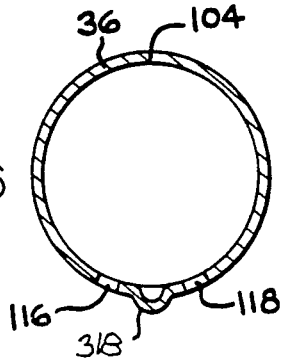
FIG. 16 is a sectional view taken along line 16—16 of FIG. 15.

Referring to FIGS. 15 and 16, there is shown the first preferred embodiment of the invention, shown in FIGS. 1–4, having a radial circular projection 318 which is identical in all respects to projection 124, except that it is formed in an outward direction, to cooperate with a conventional tubular cup-shaped female distributor terminal (not shown), rather than inwardly directed to cooperate with a converging frustoconical portion 90 of a conventional spark plug-type terminal.

This configuration is a minor modification of that shown in FIGS. 1–4, and provides a novel ignition wire terminal that can easily be produced for either male terminal or female terminal applications easily and inexpensively, and also provides an ignition wire terminal to connect an ignition cable to a conventional distributor, and which lacks parts which interfere with the installation of conventional insulating boots after assembly of the ignition cable assembly, causing damage which may lead to early failure of the insulating boot.

Figure 17:
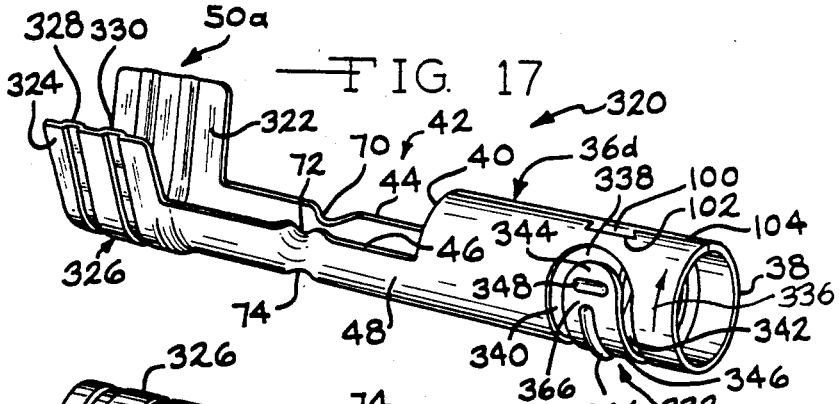
FIG. 17 is a first perspective view of an ignition wire terminal according to a fifth preferred embodiment of the invention.
Figure 18:
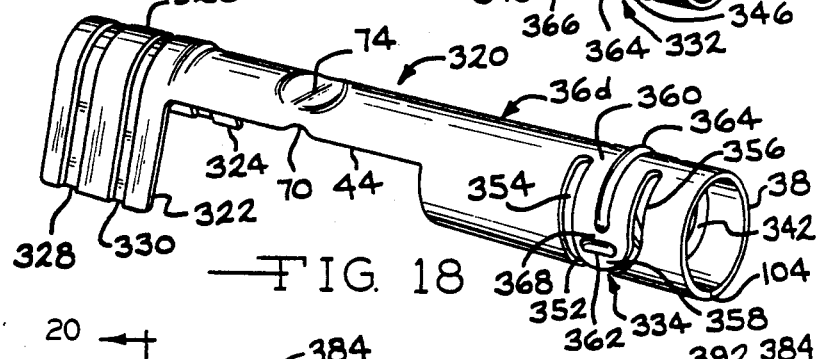
FIG. 18 is a second perspective view of the embodiment shown in FIG. 17, the ignition terminal being inverted from the position shown in FIG. 17.

FIGS. 17 and 18 illustrate a fifth preferred embodiment 320 of an ignition wire terminal according to the invention, with many similar features, having similar numbering to those features found in other embodiments of the invention. As shown, a crimpable portion 50*a* includes a first side portion 322 and a second side portion 324, and a bottom or base portion 326. Preferably, side portion 322 is longer than side portion 324, for forming a nonoverlapping crimp. Portions 322, 324 and 326 include ridge-forming grooves 328 and 330.

Barrel portion 36*d* also includes integral spring means including a first tongue portion 332 and a second tongue portion 334, circumferentially disposed in the direction indicated by arrow 336. First tongue portion 332 is defined by a generally U-shaped slot in barrel portion 36*d* having a bight portion 338 and side or leg portions 340 and 342, defining a tongue portion 332 having a tip portion 344 and a base portion 346. Tip portion 344 is provided with a radial projection 348, extending linearly in a direction parallel to axis 112 shown in FIG. 3.

Second tongue portion 334 is defined by a generally U-shaped slot including a bight portion 352, and side or leg portions 354 and 356, defining a second tongue portion 334 having a tip portion 358 and a base portion 360. Tip portion 358 is provided with a radial projection 362, similar to radial projection 348, linearly extending in the direction of axis 112, shown in FIG. 3.

In addition, barrel portion 36*d* includes a linearly-extending radial projection shown as a ridge or groove 364, circumferentially extending from adjacent radial projection 348 to adjacent radial projection 362, and defining a first gap 366 between projection 364 and projection 348, and a second gap 368 between projection 364 and projection 362. As will be apparent, projection 364 may be either an inward projection or an outward projection, and serves as a circumferential stiffening portion for increasing the spring constant of tongue portions 332 and 334.

Figure 19:
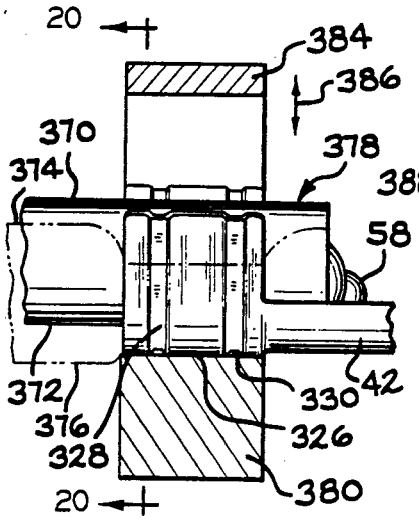
FIG. 19 is a side symbolic view of a second method of crimping n ignition wire terminal to an ignition cable.
Figure 20:
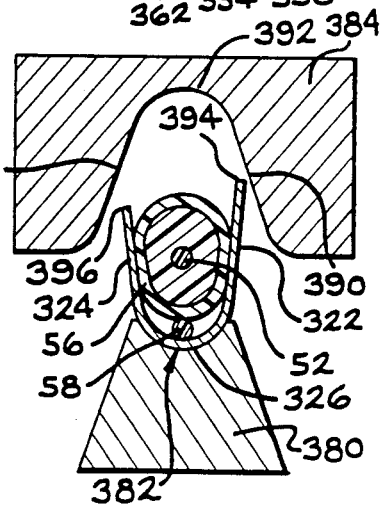
FIG. 20 is a sectional view taken along direction 20—20 in FIG. 19.

FIGS. 19 and 20 illustrate the preferred method for crimping crimpable portion 50*a* about an ignition cable such as ignition cable 32. Before crimping, the position of the ignition cable is shown by solid line 370 and 372. After crimping, the outline of the ignition cable is shown by phantom lines 374 and 376. As shown, an ignition cable is placed between side portions 322 and 324 so that a free end portion 378 extends a substantial distance beyond crimpable portion 50*a* towards barrel portion 36*d*. Crimpable portion 50*a* is placed on supporting die 380, with bottom or base portion 326 in contact with surface 382 of supporting die 380. A crimping die 384, reciprocal in the direction of arrow 386, is provided with a converging entry surface 388 and a converging entry surface 390, and an arcuate surface 392 interconnecting entry surfaces 388 and 390. As can be seen, when crimping die 384 is moved towards supporting die 380, surfaces 388, 390 and 392 will guide tip portion 394 of first side portion 322, and tip portion 396 of second side portion 324 into mutual contact, to form a nonoverlapping crimp. As can be seen, the crimping method shown in FIGS. 19 and 20 produces a funnel effect, similar to that formed by the method shown in FIGS. 13 and 14, since free end portion 378 is somewhat compressed when force is applied to ignition cable such as ignition cable 32, providing at least some of the benefits of a funnel-shaped crimp portion in retaining the layers of an ignition cable in assembled relationship.

Figure 21:
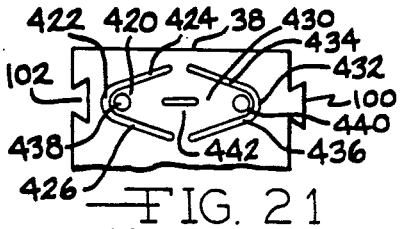
FIGS. 21–31 illustrate, in developed form, various configurations of integral springs according to less preferred embodiments of the invention.
Figure 22:
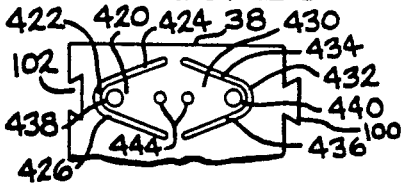
Figure 23:
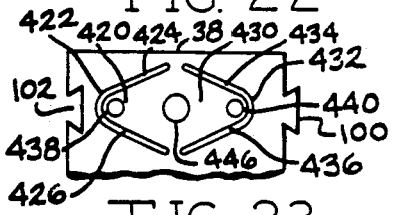

FIGS. 21–31 illustrate various other nonpreferred modifications of the invention, showing the structure of integral spring portions which may be formed in a barrel portion such as barrel portion 36, and which may be useful in some applications for an ignition wire terminal according to the invention. FIGS. 21–31 illustrate the integral spring portion of a barrel portion in developed form. As should be apparent, ignition terminals according to the invention are formed in a conventional multiple-strike stamping process, and are initially flat stamped shapes, interconnected by connecting rails, which are subsequently appropriately curved to form a barrel portion, an intermediate portion and a crimpable portion. The embodiment of FIGS. 21–31 are somewhat similar to corresponding portions of the second preferred embodiment of the invention shown in FIGS. 5 and 6, each including a generally U-shaped slot defining a first tongue portion 420, the slot including a bight portion 422 and diverging leg or side portions 424 and 426, as well as a second generally U-shaped slot defining a second tongue portion 384 defined by a generally U-shaped slot having a bight portion 432 and diverging side or leg portions 434 and 436. FIGS. 21–23 differ from each other in the provision of means for adjusting the spring tension provided to tongue portions 420, 430 to radial projections 438, 440 respectively. In FIG. 21, a circumferential slot 442 is provided to remove material from the base portions of tongue portions 420, 430, to reduce the resilience of the respective tongue portions. In FIG. 22, a pair of small holes 444 are positioned so that each hole removes material from the base portion of a tongue portion, reducing its resilience, and, in FIG. 23, a single large hole 446 accomplishes the same purpose for both tongue portions 420 and 430 simultaneously.

Figure 25:
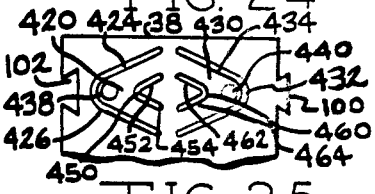

The embodiment of FIG. 25 is a further variation on the embodiment of FIG. 21, where each tongue portion defined by a diverging U-shaped slot is also provided with a diverging U-shaped slot, to provide a relatively small spring force. First tongue 420 is provided with a first tension controlling slot in the form of a generally U-shaped slot having a bight portion 450 and diverging leg portions 452 and 454 approximately parallel respectively to leg portions 424 and 426. This eliminates the material lying between legs 452 and 454 from the resilient hinge portion of tongue 420, effectively reducing its resilience. Tongue portion 430 is similarly provided with a corresponding generally U-shaped slot having a bight portion 460 and diverging leg portions 462 and 464, to the same end.

Figure 24:
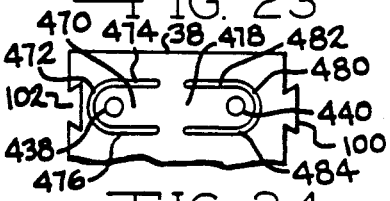

FIGS. 24, 25, 26 and 27 may be considered as variations of the second preferred embodiment shown in FIGS. 5 and 6, with varying configuration of the generally U-shaped slots which define respective tongue portions, with or without additional hole means to control or reduce the resilience of the respective tongue portions. In FIG. 24, a first tongue portion 470 is defined by a U-shaped slot having a bight portion 472 and parallel leg or side portions 474 and 476. A second tongue portion 478 is defined by a U-shaped slot having a bight portion 480 and parallel leg or side portions 482 and 484.

Figure 26:
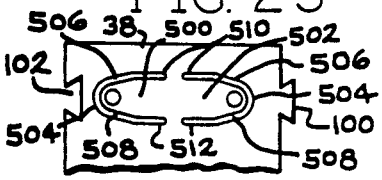

In FIG. 26, first and second tongue portions 500, 502 are formed by mirror-image slots each having a bight portion 504 and side or leg portions having both diverging portions 506, 508 and parallel portions 510 and 512.

Figure 27:
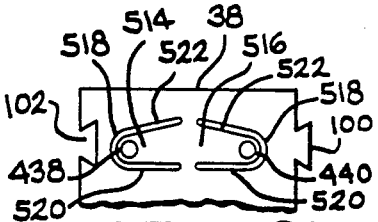

In FIG. 27, first and second tongue portions 514, 516 are defined by a mirror-image generally U-shaped groove, each having a bight portion 518, a first or side portion 520 running in a circumferential direction and a second leg or side portion 522 diverging from its corresponding side or leg 520.

Figure 28:
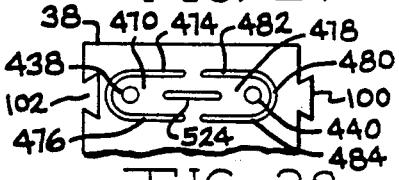

The embodiment of FIG. 28 is similar to the embodiment of FIG. 24, but includes a spring tension adjusting slot. A single circumferentially extending slot 524 extends into tongue portions 470 and 478 to reduce the amount of material at the base of tongue portions 470, 478, to reduce and control their respective resilience and spring rate. The width of this slot, as the width of all other slots, and the diameter of a hole or holes provided for this function may be increased or decreased as appropriate to control the resilience and spring tension of a tongue portion.

Figure 29:
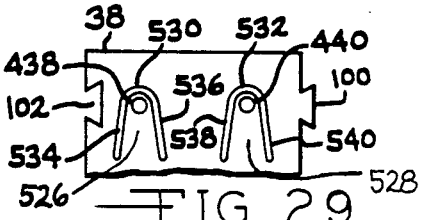

FIG. 29 is a variation of the preferred embodiment shown in FIG. 1, utilizing two smaller axial tongue portions rather than one larger axial tongue portion. First and second tongue portions 526 and 528 are defined by axially-oriented generally U-shaped grooves having respective bight portions 530, 532 and side or leg portions 534, 536 and 538, 540, where side or leg portions 534, 536 and 538, 540 are diverging side or leg portions extending generally in a direction parallel to a lengthwise axis such as axis 112 shown in FIG. 3.

Figure 30:
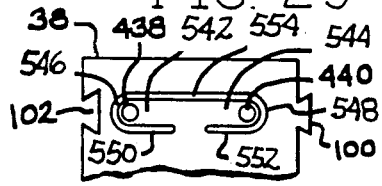
Figure 31:
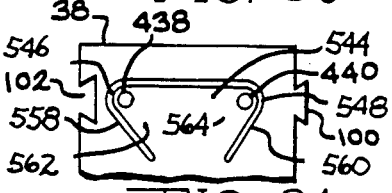

FIGS. 30. and 31 are further nonpreferred variations of the second preferred embodiment of the invention shown in FIGS. 5 and 6, and of other nonpreferred embodiments shown in the preceding figures. In the embodiment of FIG. 30, first and second tongue portions 542 and 544 defined by a single slot in the general form of two mirror-image U-shaped circumferentially extending slots with parallel legs, one parallel leg of each being continued until it connects with the facing leg or side of the other. Thus, the slot has respective bight portions 546 and 548, respective unconnected side or leg portions 550 and 552 and a single leg or side portion 554 which interconnects bights 546 and 548. The embodiment of FIG. 31 is a modification of the embodiment shown in FIG. 30, which provides higher spring tension than that of FIG. 30, with a single side or leg portion 556 interconnecting bights 546 and 548, but with diverging unconnected legs or side portions 558 and 560, defining respective base portions 562, 565 which are significantly wider than corresponding portions of the tongue portions 542, 544 in the embodiment of FIG. 30.

As will be apparent, numerous embodiments and variations of the invention may be easily made without departing from the spirit and scope of the invention, which provide the benefits of an integral spring means with controllable spring tension in an ignition wire terminal adapted for use either in straight or bent configurations, for use with either male or female connectors, with improved resistance to ignition cable pull-out, and which facilitate the undamaged installation of insulating boots.

We claim:

1. An ignition wire terminal, comprising:

a first linearly-extending cylindrical barrel portion, having a first open end portion and a second end portion:

a second linearly-extending intermediate portion integral with said second end portion, said intermediate portion having first and second edge portions and a body portion having a first end portion integral with said first cylindrical barrel portion and a second end portion integral with a third linearly-extending crimpable portion;

said third crimpable portion being a U-shaped portion having a base portion integral with said body portion and first and second side portions integral with said base portion and adapted to be crimped over an ignition cable including a folded-back core portion;

said first cylindrical barrel portion defining an integral spring means for retaining said ignition wire terminal to an ignition wire connection terminal;

said integral spring means being a tongue portion, said first cylindrical barrel portion defining a generally U-shaped slot, said U-shaped slot defining said tongue portion, said tongue portion being disposed substantially in the plane of said first cylindrical barrel portion;

said tongue portion including a tip portion, and said tip portion defining a radial projection adapted to cooperate with said ignition wire connection terminal to retain said ignition wire terminal thereto;

said integral spring means including said first mentioned tongue portion and a second tongue portion;

said first and second tongue portions each being circumferential tongue portions;

each said tongue portion including a tip portion including a radial projection adapted to cooperate with said ignition wire connection terminal to retain said ignition wire terminal thereto; and said first cylindrical barrel portion including a third radial projection therefrom, said third radial projection being a linearly-extending circumferential projection extending from adjacent said radial projection of said first tongue portion to adjacent said radial projection of said second tongue portion, said first cylindrical barrel portion defining a first gap between a first end of said linearly-extending circumferential projection and said radial projection of said first tongue portion and defining a second gap between a second end of said linearly-extending circumferential projection, and said radial projection of said second tongue portion.

2. An ignition wire terminal according to claim 1 wherein:

said intermediate portion includes first, second and third deformed portions adapted to allow said intermediate portion to be bent in a first direction;

said first deformed portion being formed in said first edge portion in the direction of said second edge portion, said second deformed portion being formed in said second edge portion opposite said first deformed portion in the direction of said first deformed portion, and said third deformed portion being formed in said body portion intermediate said first deformed portion and said second deformed portion and in the direction of said first and second edge portions; and said first direction being a bend direction wherein said base portion of said crimpable portion forms an obtuse angle with said first cylindrical barrel portion.

3. An ignition terminal, comprising:

a first linearly-extending cylindrical barrel portion, having a first open end portion and a second end portion;

a second linearly-extending intermediate portion integral with said second end portion, said intermediate portion having first and second edge portions and a body portion having a first end portion integral with said first cylindrical barrel portion and a second end portion integral with a third linearly-extending crimpable portion;

said third crimpable portion being a U-shaped portion having a base portion integral with said body portion and first and second side portions integral with said base portion and adapted to be crimped over an ignition cable including a folded-back core portion;

said first cylindrical barrel portion defining an integral spring means for retaining said ignition wire terminal to an ignition wire connection terminal;

said integral spring means being a tongue portion, said cylindrical barrel portion defining a generally U-shaped slot, said U-shaped slot defining said tongue portion, said tongue portion being disposed substantially in the plane of said cylindrical barrel portion;

said tongue portion including a tip portion, and said tip portion defining a radial projection adapted to cooperate with said ignition wire connection terminal to retain said ignition wire terminal thereto;

said integral spring means including said first mentioned tongue portion and a second tongue portion;

said first and second tongue portions each being circumferential tongue portions;

each said tongue portion including a tip portion including a radial projection adapted to cooperate with said ignition wire connection terminal to retain said ignition wire terminal thereto;

said barrel portion including a third radial projection therefrom, said third radial projection being a linearly-extending circumferential projection extending from adjacent said radial projection of said first tongue portion to adjacent said radial projection of said second tongue portion, said barrel portion defining a first gap between a first end of said linearly-extending circumferential projection and said radial projection of said first tongue portion and defining a second gap between a second end of said linearly-extending circumferential projection, and said radial projection of said second tongue portion.

4. A method of terminating an ignition cable comprising the steps of:

providing an ignition wire terminal having a first linearly-extending barrel portion, a second intermediate portion, and a third linearly-extending crimpable portion, said third linearly-extending crimpable portion being a generally U-shaped portion having a first length and having a base portion and first and second side portions integral with said base portion and adapted to be crimped over an ignition cable, wherein said step of providing said ignition wire terminal includes the step of providing said second intermediate portion with first and second edge portions and a body portion and having a first deformed portion in said first edge portion and in the direction of said second edge portion and a second deformed portion in said second edge portion opposite said first deformed portion and in the direction of said first portion and a third deformed portion intermediate said first and second deformed portions and in the direction of said first and second edge portions;

bending said ignition wire terminal about said third deformed portion so that said third deformed portion is at an apex of an obtuse angle defined by said bent ignition wire terminal and so that said first and second deformed portions are straightened to form smooth undistorted bend areas at the apex of said obtuse angle defined by said bent ignition wire terminal;

providing said ignition cable with a body portion including an outer jacket portion, and having a stripped central conductive core portion protruding from an end thereof;

folding said stripped central core back over said outer jacket portion and in contact with said outer jacket portion;

placing said ignition cable having said folded back stripped central core in said crimpable portion with said core adjacent said base portion and said end of said ignition cable adjacent said second intermediate portion;

placing said base portion of said crimpable portion upon a supporting die adapted to generally conform to an outer surface of said base portion;

providing a crimping die adapted to crimp said crimpable portion of said ignition wire terminal around said body portion of said ignition cable and folded back central core portion to mechanically connect said ignition cable to said ignition wire terminal and having a second length approximately one-half of said first length of said crimpable portion;

positioning said crimpable portion so that said crimping die is adjacent and end portion of said crimpable portion distal to said end of said ignition cable; and striking said crimpable portion with said crimping die to form a retaining portion having a first generally tubular portion crimped around and comprising said ignition cable, and a funnel-shaped portion diverging from said tubular portion proximal to said end of said ignition cable, said end of said ignition cable being uncompressed;

whereby said ignition wire terminal is firmly fastened to said ignition cable.

5. An ignition cable assembly comprising:

a length of ignition cable having an outer jacket portion, a central conductive core portion and an intermediate body portion, said intermediate body portion and said outer jacket portion being removed to expose a length of said central core portion at a first end of said ignition cable, said length of said central core portion being folded back over said outer jacket portion;

a crimpable portion of an ignition wire terminal being crimped over said outer jacket portion and said folded back central core portion to establish mechanical and electrical connection between said ignition cable and said ignition wire terminal;

said ignition wire terminal including a cylindrical barrel portion adapted to connect said ignition wire terminal to an ignition wire connection terminal and an intermediate portion integral with and interconnecting said cylindrical barrel portion and said crimpable portion wherein said intermediate portion includes first and second edge portions and first, second and third deformed portions adapted to allow said intermediate portion to be bent in a first direction;

said first deformed portion being formed in said first edge portion in the direction of said second edge portion, said second deformed portion being formed in said second edge portion opposite said first deformed portion in the direction of said first deformed portion, and said third deformed portion being formed in said intermediate body portion intermediate said first deformed portion and said second deformed portion and in the direction of said first and second edge portions;

said first direction being a bend direction wherein said crimpable portion forms an obtuse angle with said cylindrical barrel portion;

said cylindrical barrel portion defining integral spring means for retaining said ignition wire terminal to said ignition wire connection terminal;

said integral spring means being a tongue portion, said cylindrical barrel portion defining generally U-shaped slot, said U-shaped slot defining said tongue portion, said tongue portion being disposed substantially in the plane of said cylindrical barrel portion; and said tongue portion including a tip portion, said tip portion defining a radial projection adapted to cooperate with said ignition wire connection terminal to retain said ignition wire terminal thereto.

6. An ignition cable assembly according to claim 5, wherein:

said integral spring means includes said first mentioned tongue portion and a second tongue portion;

said first and second tongue portions each being circumferential tongue portions;

each said tongue portion including a tip portion including a radial projection adapted to cooperate with said ignition wire connection terminal to retain said ignition wire terminal thereto.

7. An ignition cable assembly according to claim 5, wherein:

said tongue portion is a circumferential tongue portion defined by a circumferentially oriented generally U-shaped slot defined by said barrel portion and including said radial projection at said tip;

said cylindrical barrel portion further including a second radial projection disposed diametrically opposite from said first mentioned radial projection;

said first mentioned radial projection and said second radial projection being adapted to cooperate with said ignition wire connection terminal to retain said ignition wire terminal thereto.

8. An ignition cable assembly according to claim 5, wherein:

said intermediate portion includes first and second edge portions and first, second and third deformed portions adapted to allow said intermediate portion to be bent in first direction;

said first deformed portion being formed in said first edge portion in the direction of said second edge portion, said second deformed portion in the direction of said first deformed portion, and said third deformed portion being formed in said body portion intermediate said first deformed portion and said second deformed portion and in the direction of said first and second edge portions;

said first direction being a bend direction wherein said base portion of said crimpable portion forms obtuse angle with said barrel portion.

9. An ignition cable assembly according to claim 8, wherein:

said ignition wire terminal is a bent ignition wire terminal bent in said first direction;

said third deformed portion being disposed at an apex of an obtuse angle defined by said bent ignition wire terminal;

said first and second deformed portions being straightened to form smooth undistorted bend areas at the apex of said obtuse angle formed by said bent ignition wire terminal.

10. An ignition cable assembly, comprising:

a length of ignition cable having an outer jacket portion, a central conductive core portion and an intermediate body portion, said intermediate body portion and said outer jacket portion being removed to expose a length of said central core portion at a first end of said cable, said length of said central core portion being folded back over said outer jacket portion;

a crimpable portion of an ignition wire terminal being crimped over said jacket portion and said folded back core portion to establish mechanical and electrical connection between said ignition cable and said ignition wire terminal;

said ignition wire terminal including a cylindrical barrel portion adapted to connect said ignition wire terminal to an ignition wire connection terminal and an intermediate portion integral with and interconnecting said barrel portion and said crimpable portion;

said cylindrical barrel portion defining integral spring means for retaining said ignition wire terminal to said ignition wire connection terminal;

said integral spring means including a tongue portion, said cylindrical barrel portion defining a generally U-shaped slot, said U-shaped slot defining said tongue portion, said tongue portion being disposed substantially in the plane of said cylindrical barrel portion;

said tongue portion including a tip portion, and said tip portion defining a radial projection adapted to cooperate with said ignition wire connection terminal to retain said ignition wire terminal thereto;

said intermediate portion having first and second edge portions and a body portion including first, second and third deformed portions adapted to allow said intermediate portion to be bent in a first direction;

said first deformed portion being formed in said first edge portion in the direction of said second edge portion, said second deformed portion being formed in said second edge portion opposite said first deformed portion in the direction of said first deformed portion, and said third deformed portion being formed in said body portion intermediate said first deformed portion and said second deformed portion and in the direction of said first and second edge portions;

said first direction being a bend direction wherein said base portion of said crimpable portion forms an obtuse angle with said barrel portion;

said barrel portion is a locked barrel portion, said barrel portion having a seam defined by first and second edges of said barrel portion, said first and second edges including mating dovetail portions;

said tongue portion is an axial tongue portion extending in the direction of a lengthwise axis of said barrel portion;

said generally U-shaped slot having a bight portion defining said tip portion and diverging side portions defining a tongue base portion substantially wider than said tip portion.

11. An ignition cable assembly according to claim 10, wherein:

said ignition wire terminal is a bent ignition wire terminal bent in said first direction;

said third deformed portion being disposed at an apex of an obtuse angle defined by said bent ignition wire terminal;

said first and second deformed portions being straightened to form smooth undistorted bend areas at the apex of said obtuse angle formed by said bent ignition wire terminal.

12. An ignition terminal, comprising:

a first linearly extending cylindrical barrel portion, having a first open end portion and a second end portion;

a second linearly extending intermediate portion integral with said second end portion, said intermediate portion having first and second edge portions and a body portion having a first end portion integral with said first cylindrical barrel portion and a second end portion integral with a third linearly extending crimpable portion;

said third crimpable portion being a U-shaped portion having a base portion integral with said body portion and first and second side portions integral with said base portion and adapted to be crimped over an ignition cable including a folded-back core portion;

said first cylindrical barrel portion defining an integral spring means for retaining said ignition wire terminal to an ignition wire connection terminal;

said integral spring means being a tongue portion defining a generally U-shaped slot, said U-shaped slot defining said tongue portion being disposed substantially in the plane of said cylindrical barrel portion;

said tongue portion including a tip portion, and said tip portion defining a radial projection adapted to cooperate with said ignition wire connection terminal to retain said ignition wire terminal thereto;

said intermediate portion including first, second and third deformed portions adapted to allow said intermediate portion to be bent in a first direction;

said first deformed portion being formed in said first edge portion in the direction of said second edge portion, said second deformed portion being formed in said second edge portion opposite said first deformed portion in the direction of said first deformed portion, and said third deformed portion being formed in said body portion intermediate said first deformed portion and said second deformed portion and in the direction of said first and second edge portions;

said first direction being a bend direction wherein said base portion of said crimpable portion forms an obtuse angle with said barrel portion;

said barrel portion being a locked barrel portion, said barrel portion having a seam defined by first and second edges of said barrel portion, said first and second edges including mating dovetail portions;

said tongue portion is an axial tongue portion extending in the direction of a lengthwise axis of said barrel portion;

said generally U-shaped slot having a bight portion defining said tip portion and diverging side portions defining a tongue base portion substantially wider than said tip portion.

* * * * *

UNITED STATES PATENT AND TRADEMARK OFFICE

CERTIFICATE OF CORRECTION

PATENT NO. : 4,846,736

DATED : Jul. 11, 1989

INVENTOR(S) : Charles W. Powers, et al.

It is certified that error appears in the above-identified patent and that said Letters Patent is hereby corrected as shown below:

Column 13, lines 43-68 and column 14, lines 1-25, claim 3 should be deleted to appear as per attached claim 3.

Signed and Sealed this

Ninth Day of June, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,846,736

DATED : Jul. 11, 1989

INVENTOR(S) : Charles W. Powers, et al.

It is certified that error appears in the above-identified patent and that said Letters Patent is hereby corrected as shown below:

3. A method of terminating an ignition cable, comprising the steps of:

providing an ignition wire terminal having a first linearly-extending barrel portion, a second intermediate portion, and a third linearly-extending crimpable portion, said third portion being a generally U-shaped portion, a base portion and first and second side portions integral with said base portion and adapted to be crimped over an ignition cable;

providing an ignition cable including a body portion including an outer jacket portion, and having a stripped central conductive core portion protruding from an end thereof;

folding said stripped central core back over said outer jacket portion and in contact with said outer jacket portion;

placing said ignition cable having said folded back stripped central core in said crimpable portion with said core adjacent said base portion and said end of said ignition cable adjacent said second intermediate portion, said end extending a substantial distance toward said first barrel portion beyond said crimpable portion;

placing said base portion of said crimpable portion upon a supporting die adapted to generally conform to an outer surface of said base portion;

providing a crimping die adapted to crimp said crimpable portion of said ignition wire terminal around said body portion of said ignition cable and said folded back central core portion to mechanically connect said ignition cable to said ignition wire terminal; and striking said crimpable portion with said crimping die to form a first mechanical connection between said ignition cable and said ignition wire terminal having a crimped portion and an enlarged end portion of said crimpable portion adjacent said second intermediate portion.

UNITED STATES PATENT AND TRADEMARK OFFICE

CERTIFICATE OF CORRECTION

PATENT NO. : 4,846,736

DATED : July 11, 1989

INVENTOR(S) : Powers et al

It is certified that error appears in the above-identified patent and that said Letters Patent is hereby corrected as shown below:

Column 1, line 4, delete ", division,".

Column 2, line 66, after "intermediate" insert ---- channel ----.

Column 4, line 5, insert a hyphen "-" between the words "outwardly" and "facing".

Column 4, line 16, delete "n" and insert ---- an ----.

Column 4, line 47, delete "fire" insert ---- wire ----.

Column 7, line 47, after "base" insert ---- portion ----.

Column 9, line 12, delete the comma "," after "arcuate".

Column 11, line 2, delete "384" insert ---- 430 ----.

Column 11, line 34, delete "configuration" insert ---- configurations ----.

Column 12, line 7, after "30" delete the period ".".

Column 12, line 25, delete "565" insert ---- 564 ----.

UNITED STATES PATENT AND TRADEMARK OFFICE

CERTIFICATE OF CORRECTION

PATENT NO. : 4,846,736

DATED : July 11, 1989

INVENTOR(S) : Powers et al.

It is certified that error appears in the above-identified patent and that said Letters Patent is hereby corrected as shown below:

Columns 15-18 should be deleted to appear as per attached columns 15-18.

Signed and Sealed this

Twenty-third Day of February, 1993

*Attest:*

STEPHEN G. KUNIN

*Attesting Officer*

*Acting Commissioner of Patents and Trademarks* positioning said crimpable portion so that said crimping die is adjacent an end portion of said crimpable portion distal to said end of said ignition cable; and striking said crimpable portion with said crimping die to form a retaining portion having a first generally tubular portion crimped around and comprising said ignition cable, and a funnel-shaped portion diverging from said tubular portion proximal to said end of said ignition cable, said end of said ignition cable being uncompressed;

whereby said ignition wire terminal is firmly fastened to said ignition cable.

5. An ignition cable assembly comprising:

a length of ignition cable having an outer jacket portion, a central conductive core portion and an intermediate body portion, said intermediate body portion and said outer jacket portion being removed to expose a length of said central core portion at a first end of said ignition cable, said length of said central core portion being folded back over said outer jacket portion;

a crimpable portion of an ignition wire terminal being crimped over said outer jacket portion and said folded back central core portion to establish mechanical and electrical connection between said ignition cable and said ignition wire terminal;

said ignition wire terminal including a cylindrical barrel portion adapted to connect said ignition wire terminal to an ignition wire connection terminal and an intermediate portion integral with and interconnecting said cylindrical barrel portion and said crimpable portion wherein said intermediate portion includes first and second edge portions and first, second and third deformed portions adapted to allow said intermediate portion to be bent in a first direction;

said first deformed portion being formed in said first edge portion in the direction of said second edge portion, said second deformed portion being formed in said second edge portion opposite said first deformed portion in the direction of said first deformed portion, and said third deformed portion being formed in said intermediate body portion intermediate said first deformed portion and said second deformed portion and in the direction of said first and second edge portions;

said first direction being a bend direction wherein said crimpable portion forms an obtuse angle with said cylindrical barrel portion;

said cylindrical barrel portion defining integral spring means for retaining said ignition wire terminal to said ignition wire connection terminal;

said integral spring means being a tongue portion, said cylindrical barrel portion defining a generally U-shaped slot, said U-shaped slot defining said tongue portion, said tongue portion being disposed substantially in the plane of said cylindrical barrel portion; and said tongue portion including a tip portion, said tip portion defining a radial projection adapted to cooperate with said ignition wire connection terminal to retain said ignition wire terminal thereto.

6. An ignition cable assembly according to claim 5, wherein:

said integral spring means includes said first mentioned tongue portion and a second tongue portion;

said first and second tongue portions each being circumferential tongue portions;

each said tongue portion including a tip portion including a radial projection adapted to cooperate with said ignition wire connection terminal to retain said ignition wire terminal thereto.

7. An ignition cable assembly according to claim 5, wherein:

said tongue portion is a circumferential tongue portion defined by a circumferentially oriented generally U-shaped slot defined by said barrel portion and including said radial projection at said tip;

said cylindrical barrel portion further including a second radial projection disposed diametrically opposite from said first mentioned radial projection;

said first mentioned radial projection and said second radial projection being adapted to cooperate with said ignition wire connection terminal to retain said ignition wire terminal thereto.

8. An ignition cable assembly according to claim 5, wherein:

said intermediate portion includes first and second edge portions and first, second and third deformed portions adapted to allow said intermediate portion to be bent in first direction;

said first deformed portion being formed in said first edge portion being formed in said second edge portion opposite said first deformed portion in the direction of said first deformed portion, and said third deformed portion being formed in said body portion intermediate said first deformed portion and said second deformed portion and in the direction of said first and second edge portions;

said first direction being a bend direction wherein said base portion of said crimpable portion forms obtuse angle with said barrel portion.

9. An ignition cable assembly according to claim 8, wherein:

said ignition wire terminal is a bent ignition wire terminal bent in said first direction;

said third deformed portion being disposed at an apex of an obtuse angle defined by said bent ignition wire terminal;

said first and second deformed portions being straightened to form smooth undistorted bend areas at the apex of said obtuse angle formed by said bent ignition wire terminal.

10. An ignition cable assembly, comprising:

a length of ignition cable having an outer jacket portion, a central conductive core portion and an intermediate body portion, said intermediate body portion and said outer jacket portion being removed to expose a length of said central core portion at a first end of said cable, said length of said central core portion being folded back over said outer jacket portion;

a crimpable portion of an ignition wire terminal being crimped over said outer jacket portion and said folded back core portion to establish mechanical and electrical connection between said ignition cable and said ignition wire terminal;

said ignition wire terminal including a cylindrical barrel portion adapted to connect said ignition wire terminal to an ignition wire connection terminal and an intermediate portion integral with and interconnecting said barrel portion and said crimpable portion;

said cylindrical barrel portion defining integral spring means for retaining said ignition wire terminal to said ignition wire connection terminal;

said integral spring means including a tongue portion, said cylindrical barrel portion defining a generally U-shaped slot, said U-shaped slot defining said tongue portion, said tongue portion being disposed substantially in the plane of said cylindrical barrel portion;

said tongue portion including a tip portion, and said tip portion defining a radial projection adapted to cooperate with said ignition wire connection terminal to retain said ignition wire terminal thereto;

said intermediate portion having first and second edge portions and a body portion including first, second and third deformed portions adapted to allow said intermediate portion to be bent in a first direction;

said first deformed portion being formed in said first edge portion in the direction of said second edge portion, said second deformed portion being formed in said second edge portion opposite said first deformed portion in the direction of said first deformed portion, and said third deformed portion being formed in said body portion intermediate said first deformed portion and said second deformed portion and in the direction of said first and second edge portions;

said first direction being a bend direction wherein said base portion of said crimpable portion forms an obtuse angle with said barrel portion;

said barrel portion is a locked barrel portion, said barrel portion having a seam defined by first and second edges of said barr portion, said first and second edges including mating dovetail portions;

said tongue portion is an axial tongue portion extending in the direction of a lengthwise axis of said barrel portion;

said generally U-shaped slot having a bight portion defining said tip portion and diverging side portions defining a tongue base portion substantially wider than said tip portion.

11. An ignition cable assembly according to claim 10, wherein:

said ignition wire terminal is a bent ignition wire terminal bent in said first direction;

said third deformed portion being disposed at an apex of an obtuse angle defined by said bent ignition wire terminal;

said first and second deformed portions being straightened to form smooth undistorted bend areas at the apex of said obtuse angle formed by said bent ignition wire terminal.

12. An ignition terminal, comprising:

a first linearly extending cylindrical barrel portion, having a first open end portion and a second end portion;

a second linearly extending intermediate portion integral with said second end portion, said intermediate portion having first and second edge portions and a body portion having a first end portion integral with said first cylindrical barrel portion and a second end portion integral with a third linearly extending crimpable portion;

said third crimpable portion being a U-shaped portion having a base portion integral with said body portion and first and second side portions integral with said base portion and adapted to be crimped over an ignition cable including a folded-back core portion;

said first cylindrical barrel portion defining an integral spring means for retaining said ignition wire terminal to an ignition wire connection terminal;

said integral spring means being a tongue portion defining a generally U-shaped slot, said U-shaped slot defining said tongue portion being disposed substantially in the plane of said cylindrical barrel portion;

said tongue portion including a tip portion, and said tip portion defining a radial projection adapted to cooperate with said ignition wire connection terminal to retain said ignition wire terminal thereto;

said intermediate portion including first, second and third deformed portions adapted to allow said intermediate portion to be bent in a first direction;

said first deformed portion being formed in said first edge portion in the direction of said second edge portion, said second deformed portion being formed in said second edge portion opposite said first deformed portion in the direction of said first deformed portion, and said third deformed portion being formed in said body portion intermediate said first deformed portion and said second deformed portion and in the direction of said first and second edge portions;

said first direction being a bend direction wherein said base portion of said crimpable portion forms an obtuse angle with said barrel portion;

said barrel portion being a locked barrel portion, said barrel portion having a seam defined by first and second edges of said barrel portion, said first and second edges including mating dovetail portions;

said tongue portion is an axial tongue portion extending in the direction of a lengthwise axis of said barrel portion;

said generally U-shaped slot having a bight portion defining said tip portion and diverging side portions defining a tongue base portion substantially wider than said tip portion.

* * * * *